US010718335B2

(12) United States Patent
Bender et al.

(10) Patent No.: US 10,718,335 B2
(45) Date of Patent: Jul. 21, 2020

(54) TURBOMACHINE

(71) Applicant: CONTINENTAL AUTOMOTIVE GMBH, Hannover (DE)

(72) Inventors: Klaus-Werner Bender, Muenzenberg (DE); Peter Köppler, Bad Vilbel (DE)

(73) Assignee: Continental Automotive GmbH, Hannover (DE)

( * ) Notice: Subject to any disclaimer, the term of this patent is extended or adjusted under 35 U.S.C. 154(b) by 242 days.

(21) Appl. No.: 14/649,085

(22) PCT Filed: Nov. 28, 2013

(86) PCT No.: PCT/EP2013/074990

§ 371 (c)(1),
(2) Date: Jun. 2, 2015

(87) PCT Pub. No.: WO2014/086658

PCT Pub. Date: Jun. 12, 2014

(65) Prior Publication Data

US 2016/0017891 A1 Jan. 21, 2016

(30) Foreign Application Priority Data

Dec. 5, 2012 (DE) ..... 10 2012 222 336

(51) Int. Cl.
*F04D 5/00* (2006.01)
*F04D 23/00* (2006.01)
(Continued)

(52) U.S. Cl.
CPC ..... *F04D 5/007* (2013.01); *F04D 17/08* (2013.01); *F04D 23/008* (2013.01); *F04D 29/426* (2013.01); *F05B 2250/503* (2013.01)

(58) Field of Classification Search
CPC . F04D 5/00; F04D 5/002; F04D 5/007; F04D 23/008; F04D 29/426; F04D 29/4293; F05D 2250/53; F05B 2250/503
See application file for complete search history.

(56) References Cited

U.S. PATENT DOCUMENTS 3,356,033 A * 12/1967 Ullery ..... F04D 5/002 415/55.4
5,785,490 A * 7/1998 Dobler ..... F04D 5/002 415/55.4
(Continued)

FOREIGN PATENT DOCUMENTS

CN 1112989 12/1995
DE 1528705 A1 5/1969
(Continued)

OTHER PUBLICATIONS

Office Action dated Sep. 16, 2019 issued in Korean Patent Application No. 10-2015-7014577.

*Primary Examiner* — Kenneth J Hansen
(74) *Attorney, Agent, or Firm* — Cozen O'Connor

(57) ABSTRACT

A turbomachine includes a housing and an electric motor in the housing. The electric motor has a shaft, a stator, and a rotor on the shaft. At least one impeller is arranged in a pump housing and driven by the shaft, the impeller having at least one ring of rotor blades delimiting a ring of blade chambers. A side channel is arranged in the pump housing opposite the ring of blade chambers and extends from the pump inlet as far as the pump outlet. A ramp is arranged at an end of the side channel in a radially inner half of the side channel. The ramp starts from a channel bottom, rises in a flow direction as far as the height of the pump housing wall, and merges with its radially outer half into the pump outlet.

2 Claims, 1 Drawing Sheet

(51) Int. Cl.
*F04D 17/08* (2006.01)
*F04D 29/42* (2006.01)

(56) References Cited

U.S. PATENT DOCUMENTS

| | | | | |
|---|---|---|---|---|
| 5,980,200 | A | 11/1999 | Rollwage et al. | |
| 6,715,986 | B2 | 4/2004 | Takei | |
| 7,165,932 | B2 | 1/2007 | Yu et al. | |
| 7,766,604 | B2 | 8/2010 | Honda et al. | |
| 2001/0028844 | A1 | 10/2001 | Narisako et al. | |
| 2003/0068221 | A1* | 4/2003 | Kobayashi | F04D 5/002 415/55.1 |
| 2003/0103841 | A1* | 6/2003 | Yu | F04D 5/002 415/55.1 |

FOREIGN PATENT DOCUMENTS

| | | | |
|---|---|---|---|
| DE | 10211890 | A1 | 10/2002 |
| DE | 102006001568 | A1 | 7/2006 |
| DE | 102006016531 | A1 | 11/2006 |
| JP | H 07-167089 | | 7/1995 |
| JP | 2005-214106 | | 8/2005 |
| JP | 2006-291802 | | 10/2006 |

* cited by examiner

TURBOMACHINE

CROSS-REFERENCE TO RELATED APPLICATIONS

This is a U.S. national stage of application No. PCT/EP2013/074990, filed on 28 Nov. 2013, which claims priority to the German Application No. DE 10 2012 222 336.3 filed 5 Dec. 2012, the content of both incorporated herein by reference.

BACKGROUND OF THE INVENTION

1. Field of the Invention

The subject matter of the invention is a turbomachine having a housing, an electric motor which is arranged in the housing, the electric motor comprising a stator and a rotor which is arranged on a shaft, at least one impeller which is driven by the shaft, has at least one ring of rotor blades which delimit blade chambers, and is arranged in a pump housing, and having a side channel which is arranged in the pump housing, lies opposite in each case one ring of blade chambers, and extends from a pump inlet as far as a pump outlet.

2. Related Art

Turbomachines of this general type are known and are used to deliver liquids, in particular fuel, or to deliver gases, in particular air. The medium to be delivered is sucked in by the pump inlet and is delivered via the side channel and the blade chambers to the pump outlet. Here, the flow circulates between the side channel and the blade chambers. It is disadvantageous that flow losses occur during the transition into or from the circulation flow.

SUMMARY OF THE INVENTION

An object of the present invention is therefore to provide a turbomachine that has lower flow losses.

This object is achieved, in one aspect of the invention, by a ramp arranged at the end of the side channel in the radially inner half of the side channel, which ramp, starting from the channel bottom, rises in the flow direction as far as the height of the pump housing wall, and the side channel merges with its radially outer half into the pump outlet.

That part of the circulation flow that enters into the side channel is deflected by way of the arrangement of the ramp. At the same time, only that part of the circulation flow that exits from the side channel passes to the pump outlet, since the side channel merges merely with its radially outer half into the pump outlet. Improved flow conditions are achieved overall by way of the selection of the part of the flow that flows into the pump outlet and the deflection of the other part, which flow conditions result in lower flow losses and therefore an improved degree of efficiency of the turbomachine. In addition, the transition to the pump outlet has a smaller cross section than in conventional devices, as a result of which a further pressure increase of the medium to be delivered occurs. A further advantage is that the structural measures of the present invention do not cause any additional costs, with the result that the turbomachine can be manufactured with improved properties at identical costs.

It has been shown that reliable deflection of the part flow is achieved when the surface of the ramp is curved convexly in the direction of the impeller.

Depending on the geometric dimensions and the pressure conditions, a length of the ramp of from 10% to 50% of the side channel length has been proven.

If the opening of the side channel into the pump outlet joins downstream of the ramp as viewed in the flow direction, satisfactory deflection of the part flow with subsequent overflow to the pump outlet takes place.

According to another refinement, an extended effective side channel length is achieved by virtue of the fact that the ramp is offset in the flow direction, with the result that the arrangement of the ramp and the opening of the side channel into the pump outlet overlap as viewed in the flow direction.

If eddying is formed during the transition from the side channel into the pump outlet, it can be minimized by virtue of the fact that the diameter of the opening of the side channel into the pump outlet widens continuously in the flow direction to a larger diameter of the pump outlet. By way of the enlargement of the cross section, calming of the flow takes place; the slight pressure losses are negligible here.

BRIEF DESCRIPTION OF THE DRAWINGS

The invention will be described in greater detail using one exemplary embodiment. In the drawings.

DETAILED DESCRIPTION OF THE PRESENTLY PREFERRED EMBODIMENTS

Figure 1:
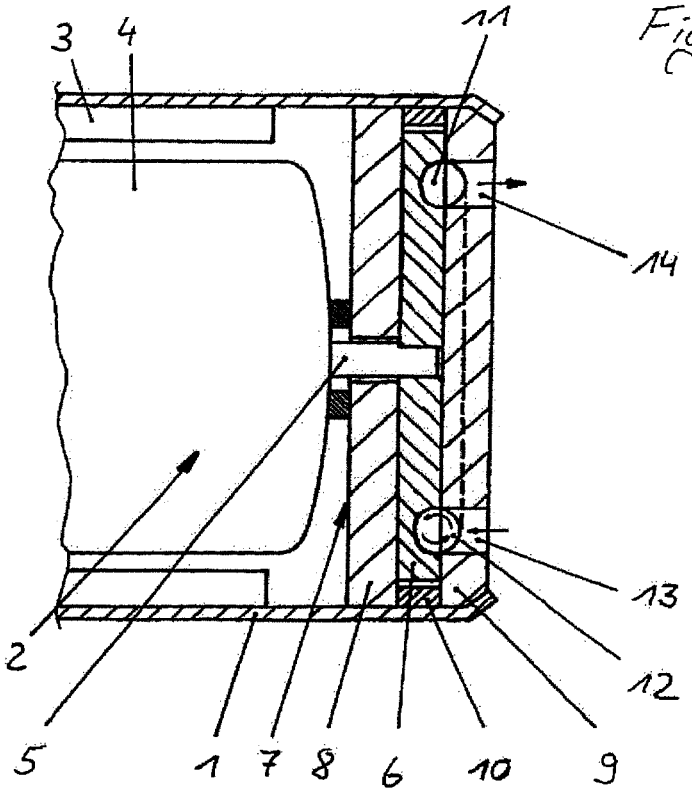
FIG. 1 shows a section through a turbomachine.

The turbo machine in FIG. 1 has a housing 1, in which an electric motor 2 is arranged. The electric motor 2 comprises a stator 3 and a rotor 4, which is arranged on a shaft 5. The shaft 5 drives an impeller 6, which is arranged in a pump housing 7. The pump housing 7 consists of a pump bottom 8 and a pump cover 9, which are spaced apart from one another by a spacer ring 10. On the side of the impeller 6 facing the pump cover 9, the impeller 6 comprises a ring of rotor blades 11 which delimit blade chambers. In the pump cover 9 of the pump housing 7, the ring of blade chambers is assigned a side channel 12 so as to lie opposite it. The side channel 12 extends from a pump inlet 13 as far as a pump outlet 14, which are both arranged in the pump cover 9. The pump inlet 13 and the pump outlet 14 usually lie next to one another and are both relocated into the plane of the drawing merely for improved illustration purposes. The blade chambers and the side channel 12 each have a semicircular cross section. The circulation flow which is formed in the blade chambers and the side channel 12 is indicated by arrows.

Figure 2:
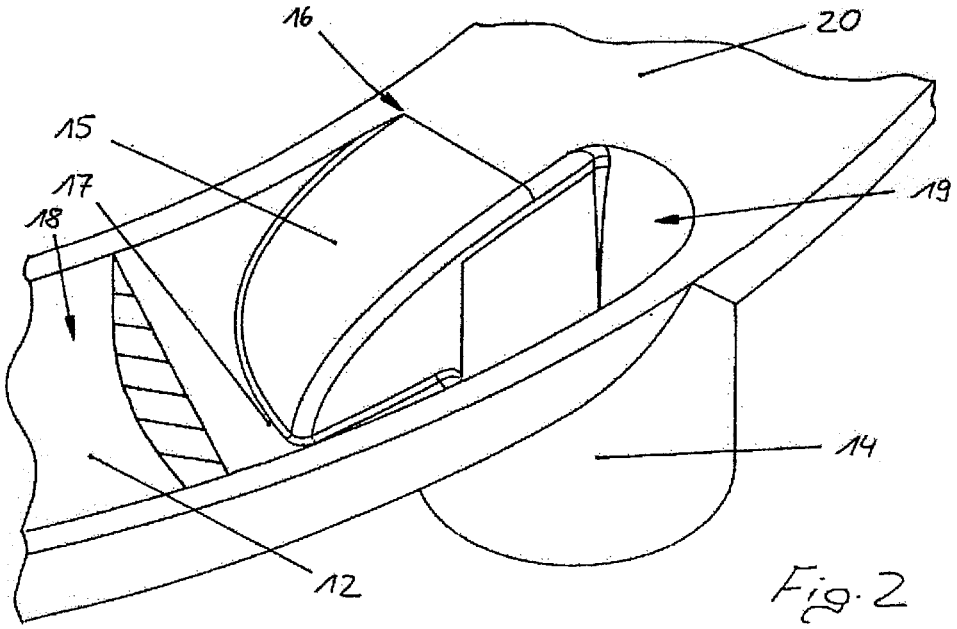
FIG. 2 shows the outlet region of the side channel.

FIG. 2 shows the side channel 12 with the pump outlet 14 in the form of a separate component, in that it has been cut out of the pump cover 9 of the pump housing 7. The hatched area shows the semicircular channel cross section. A ramp 15 is arranged at the end of the side channel 12 in the radially inner half 18 of the side channel 12. The ramp 15, starting from the channel bottom 17, rises in the flow direction as far as the height of the pump housing wall 16, the ramp 15 being curved concavely in the direction of the impeller (not shown). The side channel 12 merges with its radially outer half 19 into the pump outlet 14. The ramp 15 and the opening of the side channel 12 into the pump outlet 14 are arranged so as to overlap, as viewed in the flow direction. The side channel 12 is adjoined in the flow direction by the stripper 20 and subsequently by the pump inlet (not shown).

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A turbomachine comprising:

a motor housing (1);

an electric motor (2) arranged in the motor housing (1), the electric motor comprising:

a shaft (5), a stator (3), and a rotor (4) arranged on the shaft (5);

a pump housing (7) having a pump bottom (8), a pump cover (9), and a pump housing wall (16), the pump cover (9) having a pump inlet (13) and a pump outlet (14), at least a portion of the pump housing wall (16) forming a pump stripper (20) extending between the pump outlet (14) and the pump inlet (13);

at least one impeller (6) arranged in the pump housing (7) and driven by the shaft (5), the at least one impeller (6) having at least one ring of rotor blades (11) that delimit a ring of blade chambers;

a side channel (12) arranged in the pump housing (7), the side channel (12) being arranged opposite the ring of blade chambers, the side channel (12) extending from the pump inlet (13) as far as the pump outlet (14); and a ramp (15) arranged at an end of the side channel (12) in a radially inner half (18) of the side channel (12), said ramp (15) starting from a channel bottom (17), rising, with a ramp surface having a convex curvature in a direction of the impeller (6), in a flow direction as far as a height of the pump housing wall (16), the ramp surface merging, along its entire width, into the stripper (20), so as to effect a flow deflection such that only flow over a radially outer half (19) of the side channel (12) merges into the pump outlet (14) and such that all of the flow that does not flow into the pump outlet (14) is deflected by the ramp (15) so as to rise as far as the height of the pump housing wall (16), wherein the ramp (15) is arranged with respect to the flow direction such that the ramp (15) and an opening of the side channel (12) into the pump outlet (14) overlap.

2. The turbomachine as claimed in claim 1, wherein a length of the ramp (15) is from 10% to 50% of a length of the side channel (12).

* * * * *